United States Patent [19]

Hausman et al.

[11] Patent Number: 5,011,026

[45] Date of Patent: Apr. 30, 1991

[54] SOLID WASTE DISPOSAL SCREENING APPARATUS

[76] Inventors: Ronald C. Hausman; Judith A. Hausman, both of 202 Robert Rd., Emmaus, Pa. 18049

[21] Appl. No.: 352,043

[22] Filed: May 15, 1989

[51] Int. Cl.[5] ..... B07B 1/04; B07B 1/46; B05D 25/00

[52] U.S. Cl. ..... 209/675; 209/235; 209/352; 209/392; 209/405; 220/404; 220/908; 232/43.2

[58] Field of Search ..... 209/235, 236, 352, 370–375, 209/392, 405, 408, 659, 660, 675, 680; 220/1 T, 404, 501, 908, 909; 232/43.2; 312/210.5, 211

[56] References Cited

U.S. PATENT DOCUMENTS

| | | | |
|---|---|---|---|
| 328,147 | 10/1885 | Seitz . | |
| 1,364,209 | 1/1921 | Richardson | 232/43.2 X |
| 1,373,297 | 3/1921 | Brown | 209/374 |
| 2,087,360 | 7/1937 | Shekerjian . | |
| 2,192,573 | 3/1940 | Dunajeff | 209/392 |
| 2,390,983 | 12/1945 | Bixby | 209/392 |
| 3,814,150 | 6/1974 | Gower . | |
| 3,815,774 | 6/1974 | Olsson . | |
| 4,099,286 | 7/1978 | Ishikawa . | |
| 4,494,657 | 1/1985 | Oldenkamp | 209/636 |
| 4,740,043 | 4/1988 | Kennamer | 312/211 |
| 4,878,590 | 11/1989 | Porter | 220/908 X |

FOREIGN PATENT DOCUMENTS

| | | | |
|---|---|---|---|
| 0653650 | 5/1951 | United Kingdom | 209/374 |

*Primary Examiner*—Johnny D. Cherry
*Assistant Examiner*—Edward M. Wacyra
*Attorney, Agent, or Firm*—Sanford J. Piltch

[57] ABSTRACT

A screen or grid adapted to be placed in close proximity to the receiving end of a trash receptacle housed within an enclosure which permits smaller dimensioned trash to pass through openings in the screen or grid but will prevent larger dimensioned reusable objects, such as food carrying trays, from being mistakenly or inadvertently disposed in the trash receptacle.

8 Claims, 2 Drawing Sheets

SOLID WASTE DISPOSAL SCREENING APPARATUS

BACKGROUND OF THE INVENTION

This invention resides generally in the field of waste disposal of human consumable trash items in smaller portable waste receptacles of the kind found in stores, offices and restaurants.

The present invention is usable in defeating employee and non-employee mistaken or inadvertent disposal of larger dimensioned reusable objects such a food carrying trays in fast food or cafeteria-style restaurants. For a number of years food carrying trays have been disappearing from the inventory of these restaurants without accountable breakage. It was determined that the trays were being disposed along with the uneaten food stuffs and the disposable containers, cutlery and dishware. The posting of signs failed to deter the practice of dropping the tray along with the properly disposable food stuffs, containers, cutlery and dishware into the convenient trash receptacles. This has been the practice rather than tilting the tray and shaking off the disposable items.

The plastic molded food carrying trays represent a significant expense in starting and operating a restaurant. The inadvertent disposal of the trays created a severe inventory shortage in some locations with an accompanying need to clean and recycle the previously used trays over an ever shortening time span. This problem did not even address the cost of replacement and the waiting time to receive the replacement trays.

It is, therefore, an object of the present invention to provide an inexpensive device for screening or blocking the mistaken or inadvertent discarding of larger dimensioned reusable objects such as food carrying trays when disposing of trash items carried on or with the reusable object.

It is a further object of the present invention to provide a screen or grid which will be placed over and in close proximity to the receiving end of a smaller portable waste receptacle for preventing the mistaken or inadvertent disposal of larger dimensioned reusable objects such as food carrying trays.

It is another object of the present invention to provide an easily used screen or grid that will achieve widespread acceptance in the relevant trade, i.e., fast food and cafeteria style restaurants, with little or no change in customer or employee practices.

Other objects will appear hereinafter.

SUMMARY OF THE INVENTION

The present invention is an apparatus for preventing the unintentional or mistaken disposal of a reusable object in a trash receptacle. A screen or grid is adapted to be placed over and in close proximity to the receiving end of a trash receptacle housed within an enclosure. This screen or grid permits smaller dimensioned items of trash to pass through the openings in the screen or grid but will prevent larger dimensioned reusable objects, such as food carrying trays, from being mistakenly or inadvertently disposed in the trash receptacle.

The screen or grid has a large central opening defined by an annular ring which is dimensioned smaller than the smallest dimension of the length or width of the larger dimensioned reusable objects. This opening is supported centrally within an outer perimeter of the screen or grid by support members attached to the annular ring at equidistant points along the circumference of the ring and to the perimeter at equidistant points along the perimeter.

The screen or grid may be rectangular (or shaped or configured to mate with the trash receptacle) with the support members being arcuate in shape. In the case of a rectangular screen or grid, the support members span each of the corners of the perimeter of the screen or grid.

The screen or grid may be removably mounted to the interior walls of the trash receptacle enclosure immediately above the receiving end of the trash receptacle and below the point of entry to the enclosure of disposable trash and reusable objects. Alternatively, the screen or grid be removably mounted to the receiving end of the trash receptacle housed within the enclosure and below the point of entry to the trash receptacle enclosure of disposable trash and reusable objects.

BRIEF DESCRIPTION OF THE DRAWINGS

For the purpose of illustrating the invention, there is shown in the drawings forms which are presently preferred; it being understood, however, that the invention is not limited to the precise arrangement and instrumentalities shown.

DETAILED DESCRIPTION OF THE INVENTION

The following detailed description is of the best presently contemplated modes of carrying out the present invention. This description is not intended in a limiting sense, but is made solely for the purpose for illustrating the general principles of the invention.

Figure 1:
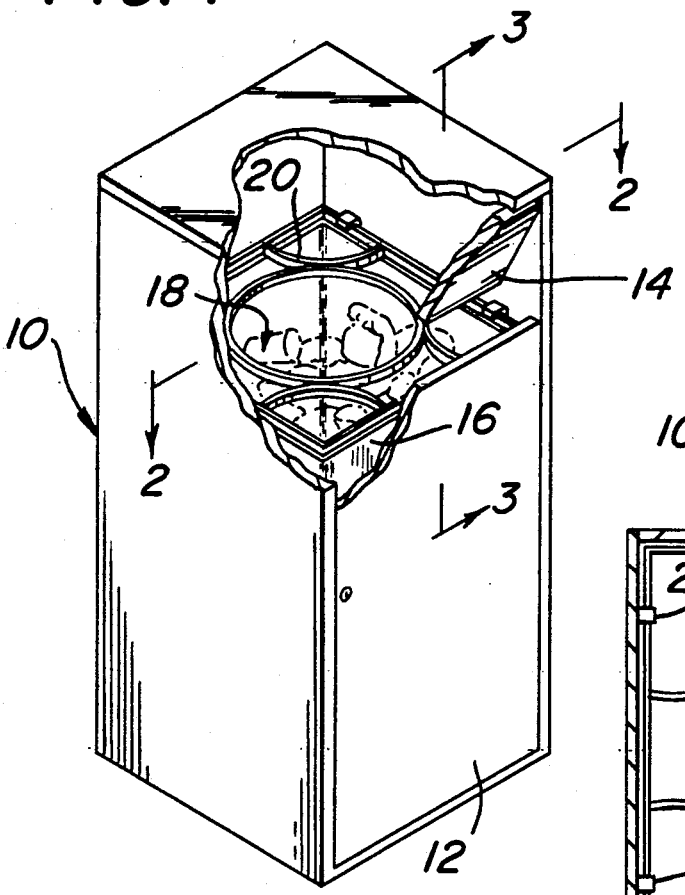
FIG. 1 is an isometric view, partially cut away, showing the arrangement of the invention within a trash receptacle enclosure.

Referring now to the drawings in detail, wherein like numerals represent like elements, there is shown in FIG. 1 a waste receptacle enclosure 10, substantially shaped as a parallelepiped, having a front door 12 hinged vertically along one side and arranged to open by swinging outward. Above the door 12 and on the same side of the enclosure 10 is a top hinged panel 14 which is hinged to open by swinging inward. Internal to the enclosure 10 is a waste receptacle 16 in which there are shown various items of disposable trash 18 including food containers, disposable cutlery and dishware, and the like. A substantially horizontal screen or grid 20 is located within the enclosure 10 in close proximity to the open end of the waste receptacle 16 which receives the deposit of the trash items. The screen or grid 20 is located at a point within the enclosure 10 just above the waste receptacle 16. This particular location, providing minimum clearance for removal of the waste receptacle 16 from the enclosure 10, negates the possibility of disposing any trash into the waste receptacle 16 without having to pass the trash through the screen or grid 20.

Figure 2:
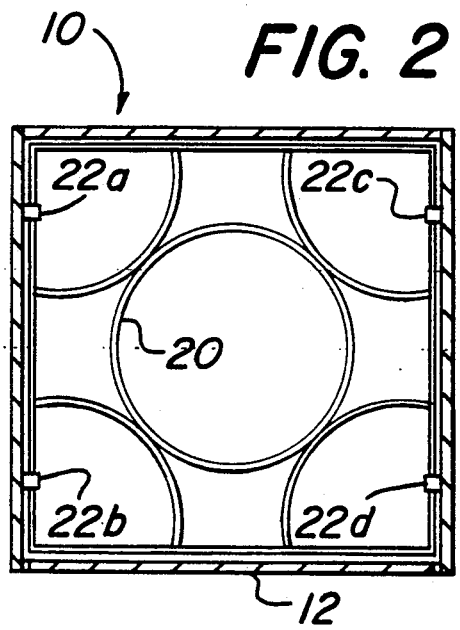
FIG. 2 is a sectional view of FIG. 1 taken along line 2—2, looking downward.
Figure 3:
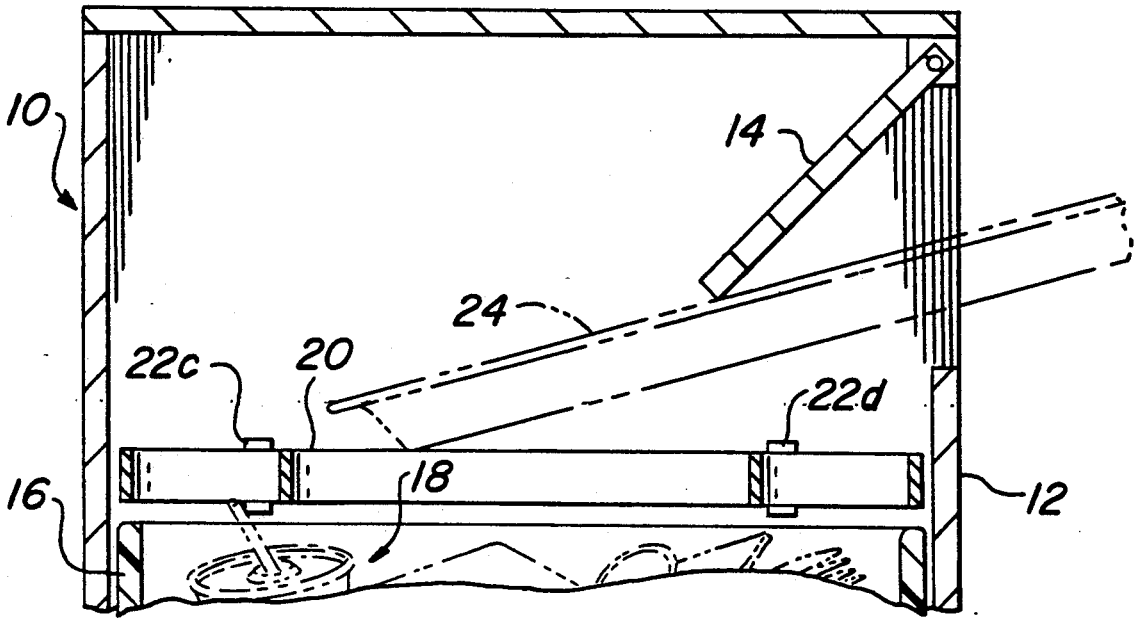
FIG. 3 is a sectional view of FIG. 1 taken along line 3—3, looking from one side toward the other with the present invention mounted to the waste receptacle enclosure.

Referring now to FIGS. 2 and 3 where a first embodiment of the present invention is depicted, the screen or grid 20 is mounted to the interior walls of the enclosure 10 at a point which is just above the maximum height of the waste receptacle 16 and below the lowest extension of the hinged panel 14 through which trash 18 may be passed.

The screen or grid 20 is comprised of a rectangular, or in the case of this embodiment square, perimeter member which is removably attached to the interior walls of the enclosure 10 at several attachment points. The specific means of attachment may be angled metal members 22*a* to 22*d* having a plurality of holes therethrough for securing by screws or similar means to the walls of the enclosure 10. This will enable the screen or grid 20 to be placed on the members, yet be removable for ease of cleaning the screen or grid 20 or the enclosure 10.

It is, however, preferred that the members 22*a*–22*d* have upper and lower extensions which protrude inwardly into the enclosure 10 and sized so that the screen or grid 20 fits exactly between the extensions. The contemplated configuration would be similar to a "u" laid on its side and attached to the enclosure through its base. This will enable the screen or grid 20 to be removed when cleaning of the enclosure 10 or when removing the waste receptacle 16 for emptying. The screen or grid 20 can then be replaced and function as will be described hereinafter.

The members 22*a*–22*d* can be of any suitable material which exhibits rigidity for maintaining the screen or grid 20 in proper alignment without displacement over the waste receptacle 16 and limited elasticity for permitting the screen or grid 20 to be inserted between the inwardly extending protrusions of the members 22*a*–22*d*. When the screen or grid 20 is positioned within the members 22*a*–22*d*, it is contemplated for the protrusions to exert some pressure against the screen or grid 20 to retard any free movement or displacement in any direction when trash is passed through the screen or grid. Suitable materials for constructing the members 22*a*–22*d* may be metals, such as stainless steel or similar alloys, or polymer plastics exhibiting the required characteristics.

The screen or grid 20, within its defined perimeter, has a centrally disposed annular ring dimensioned smaller in diameter than the smallest dimension of the length or width of the objects to be prevented from being mistakenly or inadvertently disposed. In order to properly locate and support the central annular ring of the screen or grid 20, several support members attaching to both the ring and the perimeter of the screen or grid 20 are required. These supports are preferred to be placed at positions equidistant one from the next and secured to the ring and the perimeter in a manner suitable to the material from which the screen or grid 20 is made. Suitable materials are stainless steel, for which welding would suffice as the method of attaching the support members to the ring and perimeter, or polymers, e.g. plastics, vinyls, and the like, for which securing is unnecessary as the entire screen or grid would be preferably formed using an injection molding process.

In order that the greatest permissible area for disposing of trash is achieved, the support members attaching the annular ring or the screen or grid 20 to its perimeter are preferred to be arcuately shaped. Thus, only small obstructions having limited surface area are presented by the screen or grid 20 to items of trash having dimensions smaller than the diameter of the central annular ring.

Referring to FIG. 3, a food carrying tray 24 is shown being inserted through the hinged panel 14 of the enclosure 10. Both its length and width dimensions are larger than the opening provided in the central annular ring of the screen or grid 20. Hence, the screen or grid 20 prevents the tray 24 from being mistakenly or inadvertently disposed when a customer disposes of the trash accumulated from a meal or an employee is cleaning a table. The trash, in the form of food stuffs, containers for food stuffs, disposable containers, cutlery and dishware, etc. passes through the screen or grid 20 with little problem. The tray 24 can then be properly placed in the return stack for reuse after cleaning.

Figure 4:
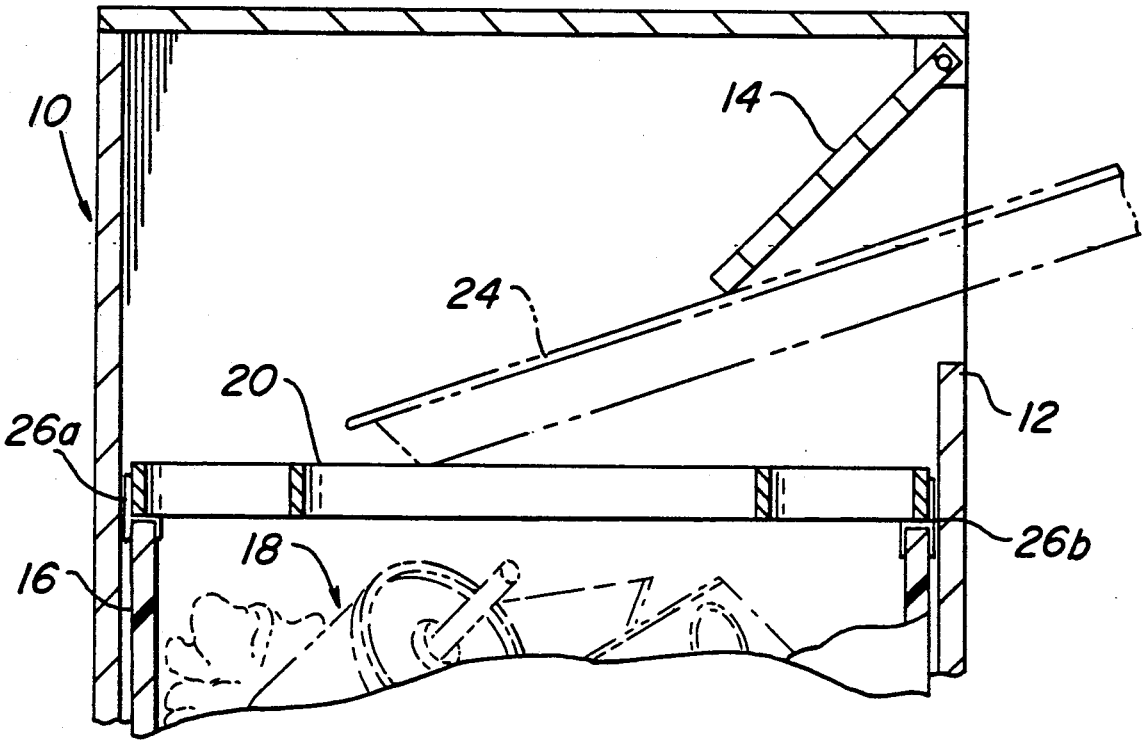
FIG. 4 is a sectional view substantially similar to FIG. 3 with the present invention mounted to the waste receptacle.

A second embodiment of the present invention is depicted in FIG. 4 showing a different method of mounting the screen or grid 20. Instead of removably mounting the screen or grid 20 to the interior walls of the enclosure 10, a mounting means is provided for placing the screen or grid 20 directly onto the waste receptacle 16. Mounting means, in the form of clips 26*a* and 26*b*, provide for the screen or grid 20 to be placed directly onto the open end edges of the waste receptacle 16. Although only two such clip means are shown in FIG. 4, a minimum of four clip means are required to stabilize the screen or grid 20 and to prevent displacement.

The clip means 26*a*, 26*b* are secured to the screen or grid 20 by welding, through the injection molding process, or through after manufacturing methods such as by using threaded attaching means (i.e., screws or nuts and bolts of a small size) or by epoxying or gluing. The clip means are configured to be attached to the exterior of the perimeter of the screen or grid 20 and extend downward to clip over the walls of the waste receptacle 16. This may be done by having a clip which is configured to position the wall of the waste receptacle 16 between two distending elements, as shown in FIG. 4, or by a single distending element which contacts only the exterior of the wall of the waste receptacle 16. Either method will prevent lateral or vertical displacement of the screen or grid 20 while in use. Both methods also assist in holding the plastic waste bag, usually contained within the waste receptacle 16, in place with the open end of the bag folded outward over the top and along the exterior of the walls of the waste receptacle.

Figure 5:
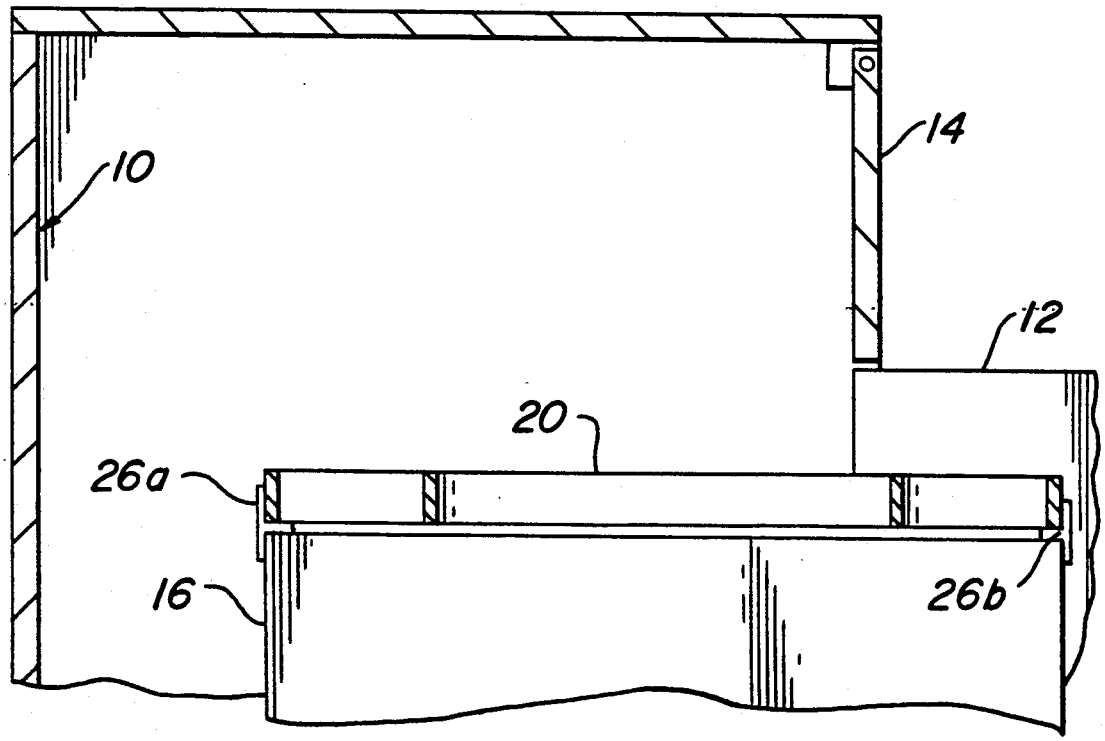
FIG. 5 is a partially cutaway view substantially similar to FIG. 4 showing the present invention mounted to the waste receptacle which is being removed from the waste receptacle enclosure.

FIG. 5 shows the waste receptacle 16 being removed from the enclosure 10 with the screen or grid 20 attached directly to the waste container by the clip means 26*a*, 26*b*. If the first embodiment of the screen or grid 20 were being used, the screen of grid could remain in place when the waste receptacle 16 is removed or the screen or grid 20 could be removed first, or be removed at the same time to facilitate the easier removal of the trash from the enclosure.

It is also contemplated by the present invention that the screen or grid 20 could be permanently affixed to the interior walls of the enclosure by screws or other suitable means. However, this is not presently preferred because it would not provide for ease of cleaning the screen or grid 20, as required by many local health laws and regulations, and would require exact dimensioning of the screen or grid perimeter to the dimensions of the interior of the enclosure 10. Although not presently preferred, this method of attachment should not be construed as being outside the scope of the invention.

The second embodiment of the present invention in which the screen or grid 20 is placed directly onto the receiving end of the waste receptacle 16 (FIG. 4) will work equally well with hinged panels positioned above the waste receptacle within a cover. The covered waste receptacle, having downward opening hinged panels in the cover, is an alternate means of collecting trash in fast food and cafeteria style restaurants. Without the screen or grid 20, when both hinged panels in the cover are opened by the tray, the opening created is large enough for the entire tray along with the items of trash on tray to slide into the waste receptacle.

The present invention may be embodied in other specific forms without departing from the spirit or essential attributes thereof and, accordingly, reference should be made to the appended claims, rather than to the foregoing specification, as indicating the scope of the invention.

We claim:

1. A screen or grid adapted to be placed substantially horizontally and in close proximity to the trash receiving end of a trash receptacle housed within an enclosure member having upstanding interior walls which permits smaller dimensioned trash to pass through openings in the screen or grid but will prevent larger dimensioned reusable objects, such as food carrying trays, from being mistakenly or inadvertently disposed of in the trash receptacle, said grid characterized by having a large central opening defined by an annular ring and being dimensioned smaller than the smallest dimension of the length or width of the larger dimensioned reusable objects, said opening supported centrally within an outer perimeter of the screen or grid by support members attached to the annular ring at equidistant points along the circumference of the ring and to the perimeter at equidistant points along the perimeter.

2. The screen or grid of claim 1 wherein the outer perimeter of the screen or grid is rectangular and the support members are arcuate and span each of the corners of the perimeter of the screen or grid.

3. The screen or grid of claim 1 being removably mounted to the interior walls of the enclosure member immediately above the receiving end of the trash receptacle and below the point of entry to the enclosure member for disposable trash.

4. The screen or grid of claim 1 being removably mounted to the receiving end of the trash receptacle housed within the enclosure member and below the point of entry to the trash receptacle enclosure member for disposable trash.

5. In combination, a trash receptacle, a trash receptacle housing having upstanding interior walls, and a screen or grid, the latter adapted to be placed substantially horizontally and in close proximity to the receiving end of the trash receptacle which permits smaller dimensioned trash to pass through openings in the screen or grid but will prevent larger dimensioned reusable objects, such as food carrying trays, from being mistakenly or inadvertently disposed of in the trash receptacle, said grid characterized by having a large central opening defined by an annular ring and being dimensioned smaller than the smallest dimension of the length or width of the larger dimensioned reusable objects, said opening supported centrally within an outer perimeter of the screen or grid by support members attached to the annular ring at equidistant points along the circumference of the ring and to the perimeter at equidistant points along the perimeter.

6. The screen or grid of claim 5 wherein the outer perimeter of the screen or grid is rectangular and the support members are arcuate and span each of the corners of the perimeter of the screen or grid.

7. The screen or grid of claim 5 being removably mounted to the interior walls of the trash receptacle housing immediately above the receiving end of the trash receptacle and below the point of entry to the housing for disposable trash.

8. The screen or grid of claim 5 being removably mounted to the receiving end of the trash receptacle housed within the housing and below the point of entry to the trash receptacle housing for disposable trash.

* * * * *